US005435229A

United States Patent [19]

Coates et al.

[11] Patent Number: 5,435,229

[45] Date of Patent: Jul. 25, 1995

[54] DISPOSABLE PRELOAD TOOL FOR VACUUM ACTUATORS

[75] Inventors: Michael E. Coates; Randal J. Graves, both of Marshall, Mich.

[73] Assignee: Eaton Corporation, Cleveland, Ohio

[21] Appl. No.: 210,792

[22] Filed: Mar. 18, 1994

[51] Int. Cl.[6] ..... F15B 15/24

[52] U.S. Cl. ..... 92/13.2; 92/13.41; 92/95; 92/131; 92/145; 137/316

[58] Field of Search ..... 92/13.2, 13.41, 13.7, 92/99, 95, 100, 128, 131, 145; 137/316; 123/401

[56] References Cited

U.S. PATENT DOCUMENTS

| | | | |
|---|---|---|---|
| 1,689,636 | 10/1928 | Milder | 92/13.41 |
| 2,559,859 | 7/1951 | Elliot et al. | 123/117.1 |
| 3,180,235 | 4/1965 | Schmitz | 92/94 |
| 3,824,901 | 7/1974 | Shafer | 92/128 |
| 4,333,889 | 6/1982 | Faryna et al. | 92/13.2 |
| 4,446,940 | 5/1984 | Sakakibara | 180/177 |
| 4,844,044 | 7/1989 | McGovern | 123/559.1 |
| 5,078,583 | 1/1992 | Hampton | 418/201.1 |

OTHER PUBLICATIONS

Henriksen, E. K., Jig and Fixture Design Manual, (New York, Industrial Press, Inc., 1973) pp. 151–153.

*Primary Examiner*—F. Daniel Lopez
*Attorney, Agent, or Firm*—L. J. Kasper

[57] ABSTRACT

A fluid pressure actuator assembly (44) adapted for use with a valve member (42) is disclosed, the actuator being of the type comprising a housing assembly (50), and an axially moveable diaphragm assembly (56). A linkage member (48) is operably associated with said diaphragm assembly and extends axially through a linkage opening (70), and is connected to a valve member (42). A preload member (74) includes a generally annular preload portion (76) between a stop surface (55) and the diaphragm assembly (56), and in engagement with both. The preload portion (76) maintains the diaphragm assembly (56) in a position corresponding to a first position of said valve member (42), in opposition to the force of a biasing means (68). The preload member (74) includes a handle portion (78) extending axially through the linkage opening (70) whereby, after said linkage member (48) is connected to said valve member (42), the preload member (74) may be removed from the actuator through the linkage opening (70), by means of the handle portion (78).

8 Claims, 2 Drawing Sheets

FIG. 2
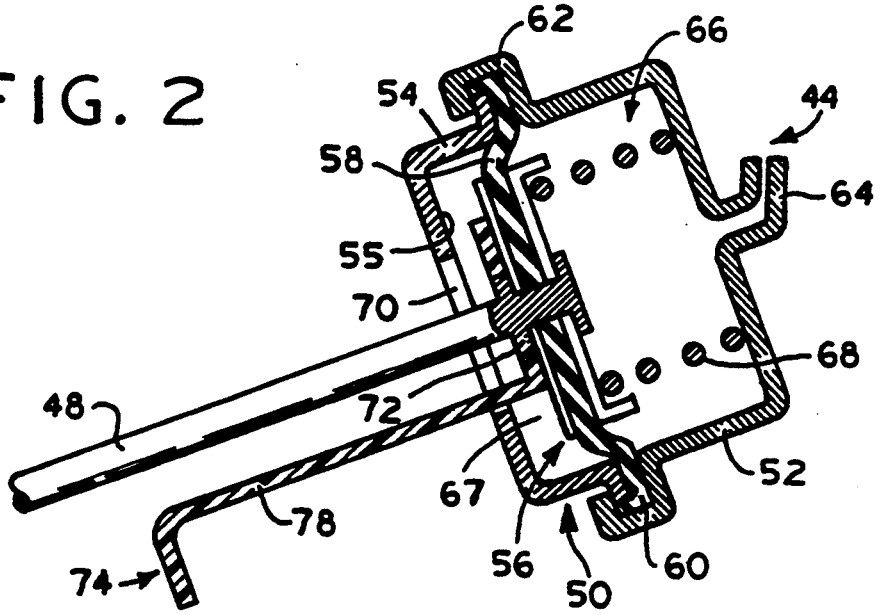
FIG. 4
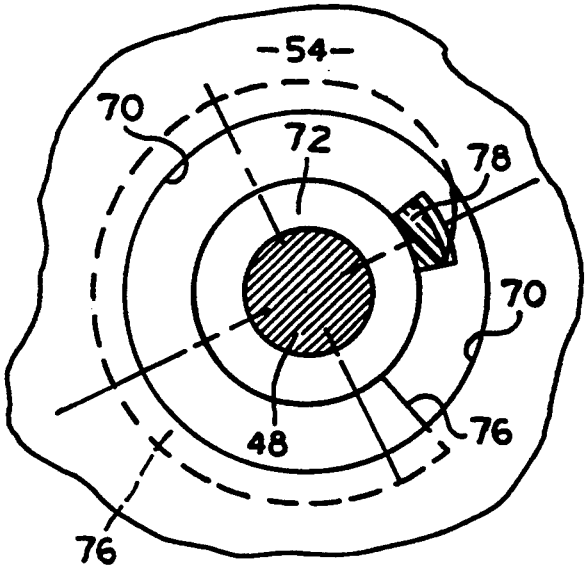
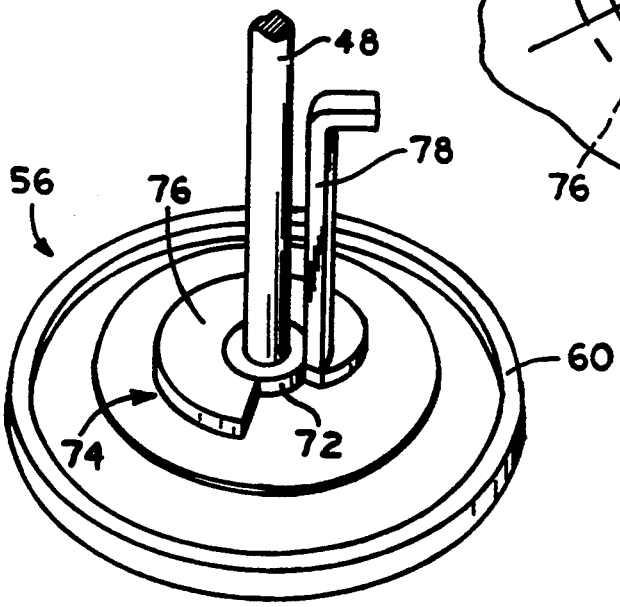
FIG. 3

DISPOSABLE PRELOAD TOOL FOR VACUUM ACTUATORS

BACKGROUND OF THE DISCLOSURE

The present invention relates to fluid pressure actuator assemblies of the type including axially moveable diaphragms, and more particularly, to a method of preloading the actuator, and a preload tool for use therein.

Although the present invention may be utilized advantageously with a number of different diaphragm-type fluid actuators (i.e., those operating on hydraulic fluid, pressurized air, etc.), it is especially advantageous when utilized with a vacuum actuator, and will be described in connection therewith.

Vacuum actuators have a number of commercial uses, one of which is illustrated and described in U.S. Pat. No. 4,844,044, assigned to the assignee of the present invention, and incorporated herein by reference. In the cited patent, which illustrates a Roots-type blower serving as a supercharger for a vehicle engine, a vacuum actuator is utilized to control the rotational position of a bypass valve. The bypass valve is located in a duct which bypasses the supercharger. Therefore, and by way of example only, when there is no vacuum being generated (nearly atmospheric pressure in the vacuum chamber), the diaphragm is spring biased toward a position closing the bypass valve, thus building pressure downstream of the supercharger. When there is a substantial vacuum in the vacuum chamber, the biasing force of the spring is overcome, retracting the diaphragm and control rod, and rotating the valve to an open position. In this condition, the supercharger is "bypassed", i.e., there is relatively low pressure downstream of the supercharger.

In a typical vacuum actuator application of the type set forth in the above-incorporated patent, it is desirable to apply a predetermined preload to the biasing spring and diaphragm prior to connecting the linkage rod to its associated valve member, etc. If no preload were exerted on the biasing spring, the fully extended position of the linkage rod would have to correspond to the normally-closed position of the associated bypass valve. This would clearly be undesirable in view of phenomena such as hysteresis and tolerance stackups.

It has been the conventional practice, in setting the preload of vacuum actuators, to utilize a special tool to hold the diaphragm assembly in the desired position, then connect the linkage rod to the bypass valve, and then finally, remove the tool from the actuator.

SUMMARY OF THE INVENTION

Accordingly, it is an object of the present invention to provide a fluid pressure actuator assembly, and a method of assembly and installation thereof, which may be set at a predetermined preload, in a manner which is accurate and repeatable, and which simplifies the overall assembly procedure.

The above and other objects of the invention are accomplished by the provision of a fluid pressure actuator assembly adapted for use with a valve member normally biased toward a first position, the actuator assembly being of the type comprising a housing assembly and an axially moveable diaphragm assembly disposed within the housing assembly. The housing assembly defines a fluid port and a linkage opening, and the diaphragm assembly cooperates with the housing assembly to define a fluid pressure chamber in communication with the fluid port, and an outlet chamber in open communication with the linkage opening. A linkage member is operably associated with the diaphragm assembly, extends axially through the outlet chamber and the linkage opening, and is adapted for connection to the valve member. The actuator includes means biasing the diaphragm assembly in either a first or second axial direction, and biasing the valve member toward the first position.

The actuator assembly is characterized by a preload member being disposed within the outlet chamber, between a stop surface and the diaphragm assembly, and in engagement therewith. The preload member maintains the diaphragm assembly in a position corresponding to the first position of the valve member, in opposition to the force of the biasing means. The preload member includes a handle portion extending axially through the linkage opening whereby, after the linkage member is connected to the valve member, the preload member may be removed from the outlet chamber, through the linkage opening by means of the handle portion.

In accordance with another aspect of the present invention, an improved method of assembling and installing the actuator assembly is provided. The method comprises the steps of:

(a) inserting a preload member within the housing assembly, the preload member including a preload portion adapted to be disposed axially between the diaphragm assembly and the stop surface, and the handle portion extending axially through the linkage opening;

(b) assembling the diaphragm assembly within the housing means;

(c) mounting the actuator assembly relative to the valve member and connecting the linkage member to the valve member; and (d) removing the preload member by means of the handle portion whereby the preload portion is removed from between the diaphragm assembly and the stop surface, through the linkage opening.

BRIEF DESCRIPTION OF THE DRAWINGS

FIG. 2 is an axial cross-section of the actuator assembly shown in FIG. 1, including the preload tool of the present invention, prior to connection to the bypass valve.

FIG. 3 is a perspective view illustrating the preload tool of the present invention assembled with the diaphragm assembly of the actuator.

FIG. 4 is a somewhat simplified view taken from the left end in FIG. 2, illustrating the preload tool of the present invention in its assembled position.

DESCRIPTION OF THE PREFERRED EMBODIMENTS

Figure 1:
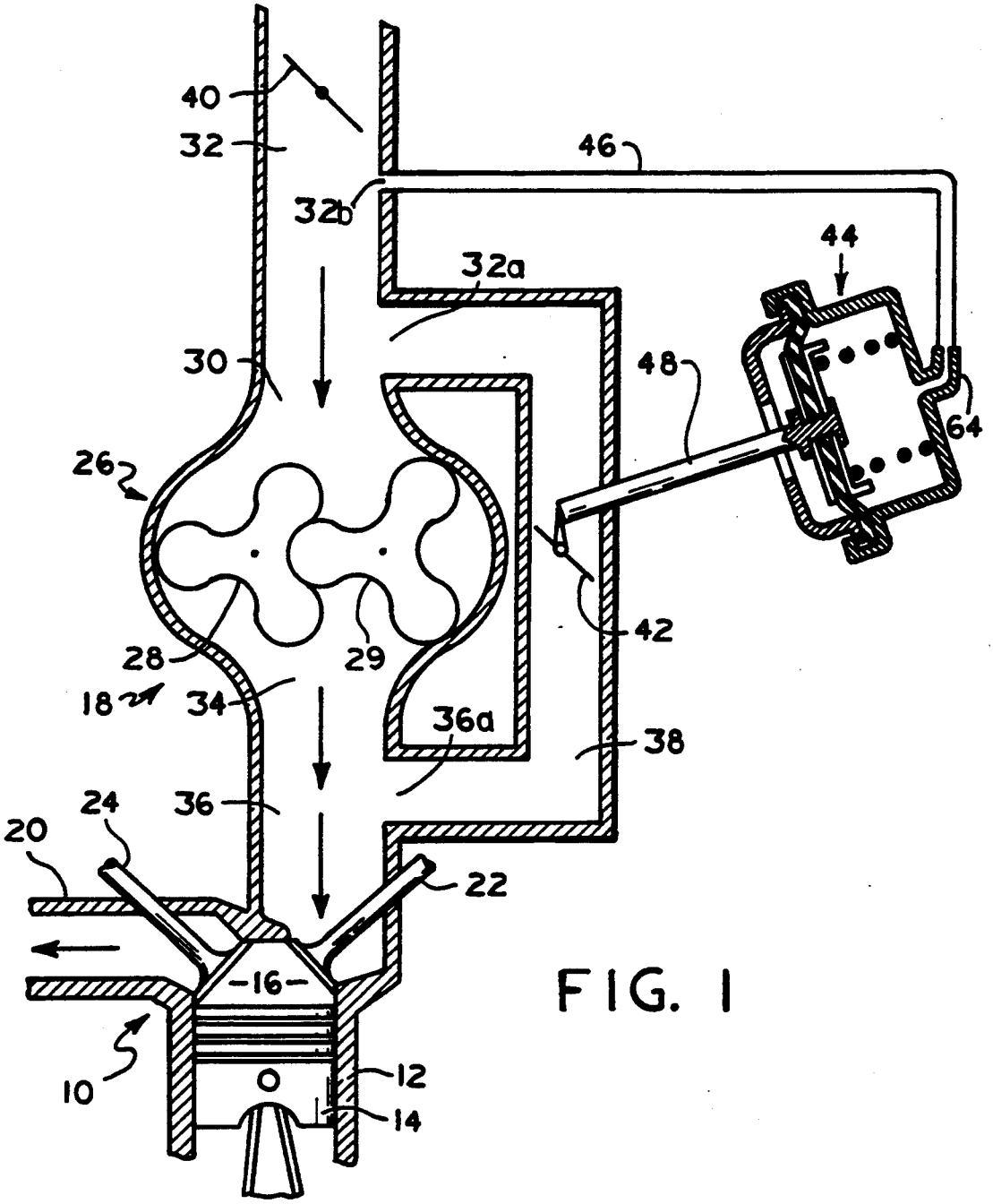
FIG. 1 schematically illustrates an intake manifold assembly of the type with which the actuator assembly of the present invention may be utilized.

Referring now to the drawings, which are not intended to limit the invention, FIG. 1 is a schematic illustration of a portion of an internal combustion engine 10 which is preferably of the periodic combustion type, such as the Otto or Diesel cycle type. The engine includes a plurality of cylinders 12, and a reciprocating piston 14 disposed within each cylinder, to define an expandable combustion chamber 16. The engine includes intake and exhaust manifold assemblies 18 and 20 for respectively directing combustion air to and from the combustion chambers 16, by way of intake and exhaust valves 22 and 24, respectively.

The intake manifold assembly 18 includes a positive displacement blower 26 of the backflow or Roots type, as is illustrated and described in greater detail in U.S. Pat. No. 5,078,583, which is assigned to the assignee of the present invention and incorporated herein by reference. The blower 26 includes a pair of rotors 28 and 29, each of which includes a plurality of meshed lobes. The rotors may be driven mechanically by engine crankshaft torque transmitted thereto in a known manner, such as by means of a drive belt (not illustrated herein). The mechanical drive rotates the blower rotors at a fixed ratio relative to crankshaft speed, such that the blower displacement is greater than the engine displacement, thereby boosting or supercharging the air flowing to the combustion chambers 16, thus increasing engine power.

The supercharger or blower 26 includes an inlet port 30 which receives air or air-fuel mixture from an inlet duct or passage 32, and further includes a discharge or outlet port 34 directing the charge to the intake valves 22 by way of a discharge duct or passage 36. The intake and discharge ducts are intercommunicated by means of a bypass duct or passage 38 connected at openings **32*a* and 36*a*, in the intake and discharge ducts 32 and 36, respectively. If the engine 10 is of the Otto cycle type, a throttle valve 40 preferably controls air or air-fuel mixture flowing into the intake duct 32** from a source, such as ambient or atmospheric air, in a well-known manner.

Disposed within the bypass duct 38 is a bypass valve 42 which is moved between an open position and a closed position by means of an actuator assembly, generally designated 44. As will be described in greater detail subsequently, the actuator assembly 44 is responsive to fluid pressure (hydraulic fluid, or air pressure or vacuum) in the inlet duct 32, by means of a pressure line 46. Therefore, the actuator assembly 44, in the subject embodiment, is operative to control the supercharging pressure in the discharge duct 36 as a function of engine power demand. When the bypass valve 42 is in the fully open position, air pressure in the discharge duct 36 is relatively low, but when the bypass valve 42 is fully closed, the air pressure in the discharge duct 36 is relatively high. The actuator assembly 44 controls the position of the bypass valve 42 by means of a linkage member 48.

Referring now primarily to FIG. 2, the actuator assembly 44 is shown in greater detail. In the subject embodiment, the actuator assembly 44 comprises a vacuum actuator, although it should be understood by those skilled in the art that the present invention may be utilized with either type of fluid pressure actuator, i.e., either a positive pressure actuator, or a negative pressure (vacuum) actuator.

The actuator 44 is preferably of the type comprising a moveable diaphragm disposed within a housing. Accordingly, the actuator 44 comprises a housing assembly, generally designated 50, including an input housing 52 and an output housing 54, including an internal surface 55 which serves as a stop surface, as will be described in greater detail subsequently. Disposed between the housings 52 and 54 is a diaphragm assembly 56, including an elastomeric diaphragm member 58 having a peripheral portion 60 trapped between the open end of the output housing 54 and a rollover portion 62 formed by the input housing 52. The input housing 52 also includes a fluid inlet port 64 which, in the subject embodiment, is connected to the pressure line 46, and is operable to draw a vacuum in a vacuum chamber 66, defined by the input housing 52 and the diaphragm assembly 56. The output housing 54 cooperates with the diaphragm assembly 56 to define an outlet chamber 67, which is merely open to the atmosphere.

Disposed within the vacuum chamber 66 is a helical, coiled compression spring 68 which seats, at its right end in FIG. 2, against the interior of the input housing 52, and seats, at its left end in FIG. 2, against the underside of the diaphragm assembly 56. The function of the spring 68 is to bias the diaphragm assembly 56, and the linkage member 48 toward a fully extended (to the left in FIG. 2) position, corresponding to a closed position of the bypass valve 42. The description of the actuator assembly 44, up to this point, is fairly conventional, and would be readily understood by those skilled in the art. The output housing 54 defines a linkage opening 70, through which the linkage member 48 extends axially as shown. The linkage opening 70 performs an additional function which will be described subsequently. The linkage member 48 includes a shoulder portion 72 disposed against the diaphragm assembly 56, to maintain a rigid connection between the linkage member 48 and the diaphragm assembly 56.

Referring now primarily to FIG. 3, and in accordance with one important aspect of the present invention, the actuator assembly 44 includes a preload tool, generally designated 74, which, in the subject embodiment comprises a single member, preferably molded from a suitable plastic material such as a polypropylene.

The preload tool 74 comprises a generally annular portion 76 and a handle portion 78. The annular portion 76, which extends about 300 degrees around the shoulder 72, is referred to as being "generally annular" although, for reasons which will be described subsequently, the portion 76 would not serve its intended function if it comprised a single, continuous, truly annular portion. As noted previously, the handle portion 78 is molded integrally with the generally annular portion 76, and preferably includes a bend (as shown in FIGS. 2 and 3) or a ring or tab or some other configuration which facilitates manipulation of the tool 74 during the installation and assembly process.

In the subject embodiment, the annular portion 76 is sized and configured such that it snaps in place about the outer periphery of the shoulder portion 72. Thereafter, the preload tool 74 comprises part of the diaphragm assembly 56 (as shown in FIG. 3) for purposes of subsequent assembly of the entire actuator 44, and the tool 74 remains in place, as shown in FIG. 3, with no other independent means required to hold it in the position shown. References hereinafter to the portion 76 "engaging" the diaphragm assembly will be understood to require merely that the portion 76 engages some part of the assembly 56, or something which moves therewith.

The axial thickness of the generally annular portion 76 is selected to correspond to a desired axial position (and preload) of the diaphragm assembly 56. In other words, if the desired preload on the bypass valve 42, in its closed position, corresponds to a position of the diaphragm assembly 56 which is separated from the stop surface 55 of the output housing 54 by a distance of 0.180 inches (by way of example only), then the axial thickness of the annular portion 76 would also be 0.180 inches. In FIG. 2, the annular portion 76 of the tool 74 is shown spaced apart from the stop surface 55, for clarity of illustration, although it should be understood that, after assembly of the actuator 44 (to be described below), the annular portion 76 would be disposed against the stop surface 55.

Actuator Assembly

After the preload tool 74 is disposed about the shoulder portion 72 as shown in FIG. 3, the resulting diaphragm assembly 56, including the preload tool 74, is assembled within the housing assembly 50. First, the output housing 54 is put in place with the linkage member 48 and handle portion 78 extending through the opening 70 as shown in FIG. 2. Next, the input housing 52 (with the spring 68 in place) has its portion 62 rolled over, as shown in FIG. 2, thus completing assembly of the housing assembly 50.

The entire actuator assembly 44 is then attached or mounted in some manner so that it is fixed relative to the bypass duct 38 and bypass valve 42. At the same time, the linkage member 48 is connected to the bypass valve 42, while the valve is in its closed position (in the subject embodiment, and by way of example only).

Once the above-described assembly procedure is completed, the relationship of the bypass valve 42, in its closed position, is fixed relative to the diaphragm assembly 56, with the desired amount of preload of the spring 68 acting thereon. The final step is to remove the preload tool 74 which may be done by grasping the handle portion 78 and pulling it axially (to the left in FIG. 2), which will disengage the annular portion 76 from about the shoulder portion 72, and from between the diaphragm assembly 56 and the stop surface 55 of the output housing 54. The above-described disengagement step will typically involve deforming the preload tool 74, at least temporarily. The preload tool 74 may then be discarded, or if desired, may be subsequently used again, as long as it has not been damaged during the previous removal step.

It may now be understood that the reason for the configuration of the generally annular portion 76 is to permit removal of the annular portion 76 from about the shoulder portion 72, and through the opening 70, It may also be seen why the portion 76 defines a circle larger than that defined by the linkage opening 70 (see FIG. 4). It is actually only that part of the annular portion 76 extending beyond the opening 70 which engages the stop surface 55.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A fluid pressure actuator assembly adapted for use with a valve member normally biased toward a first position, said actuator assembly being of the type comprising a housing assembly, and an axially moveable diaphragm assembly disposed within said housing assembly; said housing assembly defining a fluid port and a linkage opening, and said diaphragm assembly cooperating with said housing assembly to define a fluid pressure chamber in fluid communication with said fluid port, and an outlet chamber in open communication with said linkage opening; a linkage member operably associated with said diaphragm assembly, extending axially through said outlet chamber and said linkage opening, and adapted for connection to said valve member; means biasing said diaphragm assembly in one of first and second axial directions, and biasing said valve member toward said first position; said actuator assembly being characterized by:

(a) a preload member being disposed within said outlet chamber, between a stop surface and said diaphragm assembly, and in engagement therewith;

(b) said preload member maintaining said diaphragm assembly in a position corresponding to said first position of said valve member, in opposition to the force of said biasing means; and (c) said preload member including a handle portion extending axially through said linkage opening whereby, after said linkage member is connected to said valve member, said preload member may be removed from said outlet chamber through said linkage opening, by means of said handle portion.

2. A fluid pressure actuator assembly as claimed in claim 1, characterized by said fluid port being connected to a vacuum source, whereby, in the presence of vacuum at said fluid port, said diaphragm assembly is moved to reduce said fluid pressure chamber in opposition to the force of said biasing means.

3. A fluid pressure actuator assembly as claimed in claim 1, characterized by said housing assembly comprising first and second cup-shaped members, and said diaphragm assembly includes a peripheral diaphragm portion fixed relative to said first and second members, at a junction therebetween.

4. A fluid pressure actuator assembly as claimed in claim 1, characterized by said linkage member defining a shoulder portion in engagement with said diaphragm assembly and disposed in said outlet chamber, said preload member comprising a generally annular portion in engagement with said shoulder portion.

5. A fluid pressure actuator assembly as claimed in claim 1, characterized by said biasing means comprising a coiled compression spring member disposed within said fluid pressure chamber, and in engagement with said diaphragm assembly.

6. A method of assembling and installing a fluid pressure actuator assembly and valve member, adapted to be normally biased toward a first position, the actuator assembly being of the type comprising a housing assembly, an axially moveable diaphragm assembly, said housing assembly defining a linkage opening, a linkage member operably associated with said diaphragm assembly and extending axially through said linkage opening and adapted for connection to said valve member, and means biasing said diaphragm assembly toward said linkage opening; said method comprising the steps of:

(a) inserting a preload member within said housing assembly, said preload member including a preload portion adapted to be disposed axially between said diaphragm assembly and a stop surface defined by said housing assembly, and a handle portion extending axially through said linkage opening;

(b) assembling said diaphragm assembly within said housing means;

(c) mounting said actuator assembly relative to said valve member and connecting said linkage member to said valve member; and (d) removing said preload member, by means of said handle portion, whereby said preload portion is removed from between said diaphragm assembly and said stop surface, through said linkage opening.

7. A method as claimed in claim 6 characterized by said linkage member including a shoulder portion disposed adjacent said diaphragm assembly, said preload portion comprising a generally annular portion, and said step (a) includes the step of disposing said generally annular portion in engagement about said shoulder portion.

8. A method as claimed in claim 7 characterized by said step (d) comprises deformably removing said generally annular preload portion from between said diaphragm assembly and said stop surface.

* * * * *